US005290112A

United States Patent [19]

Stempfle et al.

[11] Patent Number: 5,290,112

[45] Date of Patent: Mar. 1, 1994

[54] MATRIX PRINT HEAD, IN PARTICULAR SERIAL MATRIX PIN PRINT HEAD

[75] Inventors: Johann Stempfle, Pfaffenhofen; Bernd Gugel, Ulm Einsingen, both of Fed. Rep. of Germany

[73] Assignee: Mannesmann Aktiengesellschaft, Düsseldorf, Fed. Rep. of Germany

[21] Appl. No.: 628,715

[22] Filed: Dec. 17, 1990

[30] Foreign Application Priority Data

Dec. 18, 1989 [EP] European Pat. Off. ..... 89250118.0

[51] Int. Cl.[5] ..... B41J 2/275

[52] U.S. Cl. ..... 400/124; 400/157.2; 101/93.29

[58] Field of Search ..... 400/121, 124, 157.2, 400/124; 101/93.29, 93.48; 355/279, 280, 281

[56] References Cited

U.S. PATENT DOCUMENTS

| | | | |
|---|---|---|---|
| 3,626,343 | 12/1971 | Bohlke | 335/281 |
| 4,167,343 | 9/1979 | Golobay | 400/124 |
| 4,242,004 | 12/1980 | Adler | 400/124 |
| 4,881,832 | 11/1989 | Mitsuishi et al. | 400/124 |
| 4,993,854 | 2/1991 | Sato | 400/124 |
| 5,000,593 | 3/1991 | Gugel et al. | 400/124 |
| 5,011,308 | 4/1991 | Shimosato et al. | 400/124 |
| 5,074,687 | 12/1991 | Gugel et al. | 400/124 |

FOREIGN PATENT DOCUMENTS

| | | | |
|---|---|---|---|
| 280864 | 9/1988 | European Pat. Off. | 400/124 |
| 120356 | 9/1981 | Japan | 400/124 |
| 61589 | 4/1982 | Japan | 400/124 |
| 165267 | 10/1982 | Japan | 400/124 |
| 20469 | 2/1983 | Japan | 400/124 |
| 55255 | 4/1983 | Japan | 400/124 |
| 155705 | 9/1983 | Japan | 400/124 |
| 302061 | 12/1988 | Japan | 400/124 |

OTHER PUBLICATIONS

"Rhomboidal Paddle Design for Printer Lever Arm", Anonymous; *Research Disclosure*, Jun. 1987, No. 278.

"Controls for Automated Adjustment . . . "; Anonymous; *IBM Tech. Disc. Bull*; vol. 31, No. 4, Sep. 1988, pp. 347-351.

*Primary Examiner*—David A. Wiecking

*Attorney, Agent, or Firm*—Horst M. Kasper

[57] ABSTRACT

A matrix pin print head with a print pin guide casing (7) and a print pin drive casing (9) comprises an electromagnetic drive (12). The electromagnetic drive (12) comprises a magnet yoke (13) with an electromagnetic coil (14) disposed on a magnet yoke arm (13*a*) and with an armature (15). The armature (15) can be pivoted based on a pin bearing (16) and rests in a rearward position against a stop (18) by means of a spring (17). An operating air gap (20) is formed between the armature (15) and a magnet yoke arm front face (19). A recess (22) is disposed in the middle of the magnet yoke thickness (21) to furnish the preconditions for an assembly line production exhibiting the corresponding precision and a correspondingly bundled magnetic flux. A pin driving arm (15*a*) of the armature is pivotably supported in the recess (22) by way of the hinge pin (23), wherein the hinge pin axis (23*a*) runs laterally to the region of the magnet yoke arm center (24).

36 Claims, 6 Drawing Sheets

MATRIX PRINT HEAD, IN PARTICULAR SERIAL MATRIX PIN PRINT HEAD

BACKGROUND OF THE INVENTION

1. Field of the Invention

The invention relates to a matrix pin print head, in particular a serial matrix pin print head, which is disposed at a pin stroke distance opposite to a substrate support, where an imprint-receiving substrate rests on the substrate support, and where an ink ribbon is guided in front of the imprint-receiving substrate. The pin print head comprises a print-pin guide casing and a print-pin drive casing, where an electromagnetic drive is disposed in the print-pin drive casing and is coordinated to each print pin or impact pin. The electromagnetic drive comprises a magnet yoke. An electromagnetic coil is disposed at one magnet yoke arm of the magnet yoke. The electromagnetic drive further comprises an armature, which can be pivoted based on a pin bearing and which can rest in a rearward position against a stop based on a spring. An operating air gap is formed between the armature and a front face of the magnet yoke arm.

The invention further relates to a method for the production of an electromagnetic drive for matrix print heads, in particular for serial matrix pin print heads, where the electromagnetic drive comprises in each case a magnet yoke, an electromagnetic coil disposed on one yoke arm of the magnet yoke, and an armature which is pivotable based on a pin bearing.

2. Brief Description of i& Background of the Invention Including Prior Art

In order to generate a high number per unit of time of print dots with the ends of the print pins or impact pins, the armatures of such matrix print heads can be attracted to be positioned in a rapid sequence against the pole faces of the magnet yokes and can be released back into a rest position. The frequency of such matrix print heads has reached by now about 2000 Hz and it is desired to further increase this frequency to at least 3000 Hz for each print element. Because of the high frequencies, such matrix print heads are employed in printers for a high data output furnished by computers.

A matrix print head is known from the U.S. Pat. No. 4,242,004, which exhibits the features of the matrix print head recited above. It is further known to attach an impact pin to a spring arm, which allows to obtain a particular kinematic situation in contrast to the teaching of U.S. Pat. No. 4,242,004. This latter construction, where the impact pin is attached to the spring arm, requires however a very broad armature and is consequently not suitable for the structure of an 18-pin or 24-pin print head. Moreover, the known print head is disadvantageous for a production which requires a reliance on necessary precision and uniformity.

SUMMARY OF THE INVENTION

1. Purposes of the Invention

It is an object of the present invention to provide a print head suitable for assembly line production, where such print head achieves the required precision and the requirement high frequency.

It is another object of the present invention to provide a matrix print head with a narrow armature, suitable for 18-pin or 24-pin print-heads, which operates reliably.

These and other objects and advantages of the present invention will become evident from the description which follows.

2. Brief Description of the Invention

The present invention provides for a matrix print head, in particular a serial matrix print head. A print pin drive casing frame has a middle area. A magnet yoke has a first magnet yoke arm and a second magnet yoke arm. The magnet yoke is attached to the print pin drive casing and includes a recess disposed in the center relative to a magnet yoke thickness located perpendicular to a U-configuration of the magnet yoke. An electromagnetic coil is disposed on the first magnet yoke arm of the magnet yoke. A hinge pin, having a hinge pin axis, is disposed near a corner of the U-configuration. Said hinge pin is held by the magnet yoke and passes through the recess. An armature is associated with the magnet yoke and includes a pin driving arm. The pin driving arm of the armature is pivotably hinged around the hinge pin and submerged in the recess around the hinge pin. A stop provides a rest position for the armature in a rearward position. A spring presses the armature against the stop based on an elastic force of the spring such that an operating air gap is present between the armature and a front face of one of the magnet yoke arms. A substrate support supports an imprint-receiving substrate resting on the substrate support. An ink ribbon is disposed and guided in front of the substrate support. An impact pin is attached with a first end to the armature and is disposed with a second end at a print pin stroke distance opposite to the substrate such that the ink ribbon is disposed between the impact pin and the substrate. A print pin guide casing is attached to the print pin drive casing frame for guiding the impact pin. The impact pin can be part of a serial matrix pin print head.

The hinge pin axis can run laterally relative to a region of a center of the one of the magnet yoke arms, i.e. in the region of a side face of one of the magnet yoke arms.

At least one guide plate, attached to the armature, can be furnished at a side of the armature disposed opposite to a front face of the magnet yoke. The guide plate can engage into the recess of the magnet yoke. The hinge pin axis can pass through the recess of the magnet yoke.

The hinge pin can be solidly attached to the armature and the magnet yoke. The armature and the magnet yoke can be furnished by lamellae. The lamellae can be disposed layered on top of each other. At least one recess, disposed centrally relative to the magnet yoke, can be furnished with a thickness of a second lamella. Said second lamella can form the pin driving arm. The armature can be formed with an about trapezoidal cross-section at a position opposing the faces of the two arms of the magnet yoke.

A lubricant can be intercalated and disposed between neighboring individual lamellae.

The magnet yoke, the armature having a pin driving arm, and the hinge pin can form a drive unit for an assembled state of the electromagnetic coil. Said hinge pin axis can be disposed relatively close to said middle area.

According to a further embodiment of the invention there is provided for a matrix print head, in particular a serial matrix pin print head. A print pin drive casing frame has a middle area. A magnet yoke has a first magnet yoke arm and is attached to the print pin drive casing. A hinge pin support is disposed at the magnet yoke in the center relative to a magnet yoke thickness measured perpendicular to a U-configuration of the magnet yoke. Said hinge pin support is located near a corner of the U-configuration. An electromagnetic coil is disposed on the first magnet yoke arm of the magnet yoke. A hinge pin having a hinge pin axis is disposed in the hinge pin support. An armature is associated with the magnet yoke and includes a pin driving arm. The pin driving arm of the armature is pivotably hinged around the hinge pin. A stop provides a rest position for the armature. A spring presses the armature against the stop based on an elastic force of the spring such that an operating air gap is present between the armature and a front face of a magnet yoke arm. A substrate support Supports an imprint-receiving substrate resting on the substrate support. An ink ribbon is disposed and guided in front of the substrate support. An impact pin is attached with a first end to the armature and disposed with a second end at a print pin stroke distance opposite to the substrate such that the ink ribbon is disposed between the impact pin and the substrate. A print pin guide casing is attached to the print pin drive casing frame for guiding the impact pin. Said hinge pin axis can be disposed relatively close to the middle area and immediately in front of a respective end face of the arm of the magnet yoke. The hinge pin axis can be disposed less than one fiftieth of the length of the impact pin away from the center of gravity of the armature and the impact pin. The hinge pin axis can be disposed near an arm of the magnet yoke disposed relatively far away front the middle area.

The hinge pin bearing can include two plates attached to the magnet yoke for supporting the hinge pin.

A method for the production of an electromagnetic drive for matrix print heads comprises bile following steps. An electromagnetic coil is placed onto a magnet yoke arm of the magnet yoke. Magnet yoke lamellae are punched with a predefined outer shape and prepunched with a hole for a pin bearing. The thus punched magnet yoke lamellae are joined such that a pin bearing hole is produced with a preselected diameter. The pin bearing hole of preselected diameter is calibrated. A preliminary pin for supporting an armature is inserted such that a center armature lamella engages into a central recess between two lamella packets. The armature is aligned at outer edges of the magnet yoke. A punching stamp is inserted into the calibrated pin hole. The armature lamella is punched such that the armature rests without an air gap at the magnet yoke arm front face and the punching stamp is left in the hole to furnish simultaneously the bearing pin such that the armature is pivotable around the pin bearing.

According to the present invention, a recess is disposed about at the location of the middle flat symmetry plane of the magnet yoke assembly with one coil disposed at one yoke arm and representing the middle plane of a yoke thickness. A pin driving arm of the armature is pivotably supported in said recess by way of a hinge pin. The hinge pin axis runs perpendicular to the U-shape of the magnet yoke, and in particular the hinge pin axis is disposed perpendicular relative to the single symmetry plane of the magnet yoke assembly with one coil. An essential advantage of such a pin bearing is the positioning of the hinge pin outside or at the edge of the main magnetic flux, respectively, whereby lower energy losses are generated as compared to a situation where the hinge pin would be disposed near the center of the magnetic flux. It is advantageous, for example, to dispose the hinge pin in the radially inner magnet yoke arm relative to the print head and there, in particular, in the proximity of the radially inner edge. The term "radially" in this context refers to the center of the magnet pin print head. Such a print head can be advantageously produced in assembly line production. The required precision can be achieved both during the production of the armature as well as during the production of the magnet yoke and during assembly of the connection or during the alignment, respectively, relative to each other. The operational speed of the magnet system is achieved by a precisely determinable armature stroke path, because the positioning of the hinge pin axis allows a null position with zero slot of the armature in its punt position at the front face of the respective magnet yoke arm.

An advantageous embodiment of the invention comprises that at least one guide sword or plate be provided at the side of the armature disposed opposite to a magnet yoke front face. The guide plate engages into the recess of the magnet yoke. The hinge pin axis runs in the recess of the magnet yoke.

A particularly advantageous embodiment of the invention comprises that both the armature as well as the magnet yoke are made out of lamellae layers disposed on and attached to each other such that the lamellae are positioned adjacent to each other. At least one center recess, having the thickness of one lamella, forming the pin driving arm, is furnished. The armature above the two magnet yoke arms is formed with an about trapezoidal cross-section. This structure can be easily produced with standard production techniques and results in addition in a favorable mass distribution between armature and pin driving arm and thus in an optimum magnetic flux in the magnet yoke and in the armature, respectively. According to this embodiment, no magnetic flux is necessary to flow through tile pin driving arm of the armature.

A further advantageous embodiment comprises that lubricants are intercalated and disposed between tile individual lamellae. The presence of tile lubricants prevents wear and, in addition, an adhesion between the armature and the magnet yoke front faces. In addition, the circumference of the hinge pin is also lubricated. This is particularly advantageous in the area of the bearing in the magnet yoke. The transport of the lubricant is favored by magnetostrictive coefficients of the soft-magnetic materials generating magnetostriction of the parts involved, including armature and yoke.

It is in addition favorable for one magnet yoke with one armature or one pin driving arm, respectively, and a hinge pin to form a unit in the assembled state of the electromagnetic coil from a production-technical point of view. The individual parts can be produced with the desired precision and accuracy and the device group unit can thus be employed easily for a serial print head or, alternatively, for a parallel print head, forming a line component. The production decision regarding this question can thus be made based on the production numbers of the matrix print heads of the serial type or of the line-printer type, depending on the purchase order situation.

An advantageous method is furnished for the production of an electromagnetic drive for matrix print head, in particular for serial matrix pin print heads of the kind recited above. For this purposes, the following process steps are sequentially performed.

1. Punching of the magnet yoke lamellae with outer form and prepunching of a hole for the pin bearing;

2. Forming packets of the thus punched magnet yoke lamellae for the purpose of generating a pin hole with a rough, raw diameter;

3. Calibration of the rough pin hole;

4. Insertion of the armature without hinge pin or of the armature with hinge pin, respectively, in such a way that a center armature lamella engages into a central recess between two lamella packets;

5. Alignment of the armatures at the outer edges of the magnet yoke;

6. Insertion of a punching stamp into the calibrated pin hole, punching of the armature lamella, wherein the armature rests without air gap on the front face of the magnet yoke arm and wherein the punching stamp remains simultaneously as a bearing pin.

This method assures a secure and very precise position of the armature opposite to the magnet yoke. In addition, the magnetic properties of the matrix print head are substantially improved. In particular, the setting of the air gap in the print position is thereby optimally configured.

The novel features which are considered as characteristic for the invention are set forth in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

In the accompanying drawing, in which are shown several of the various possible embodiments of the present invention:

FIG. 6 is a side elevational view of an embodiment similar to FIG. 2a.

DESCRIPTION OF INVENTION AND PREFERRED EMBODIMENT

Figure 1:
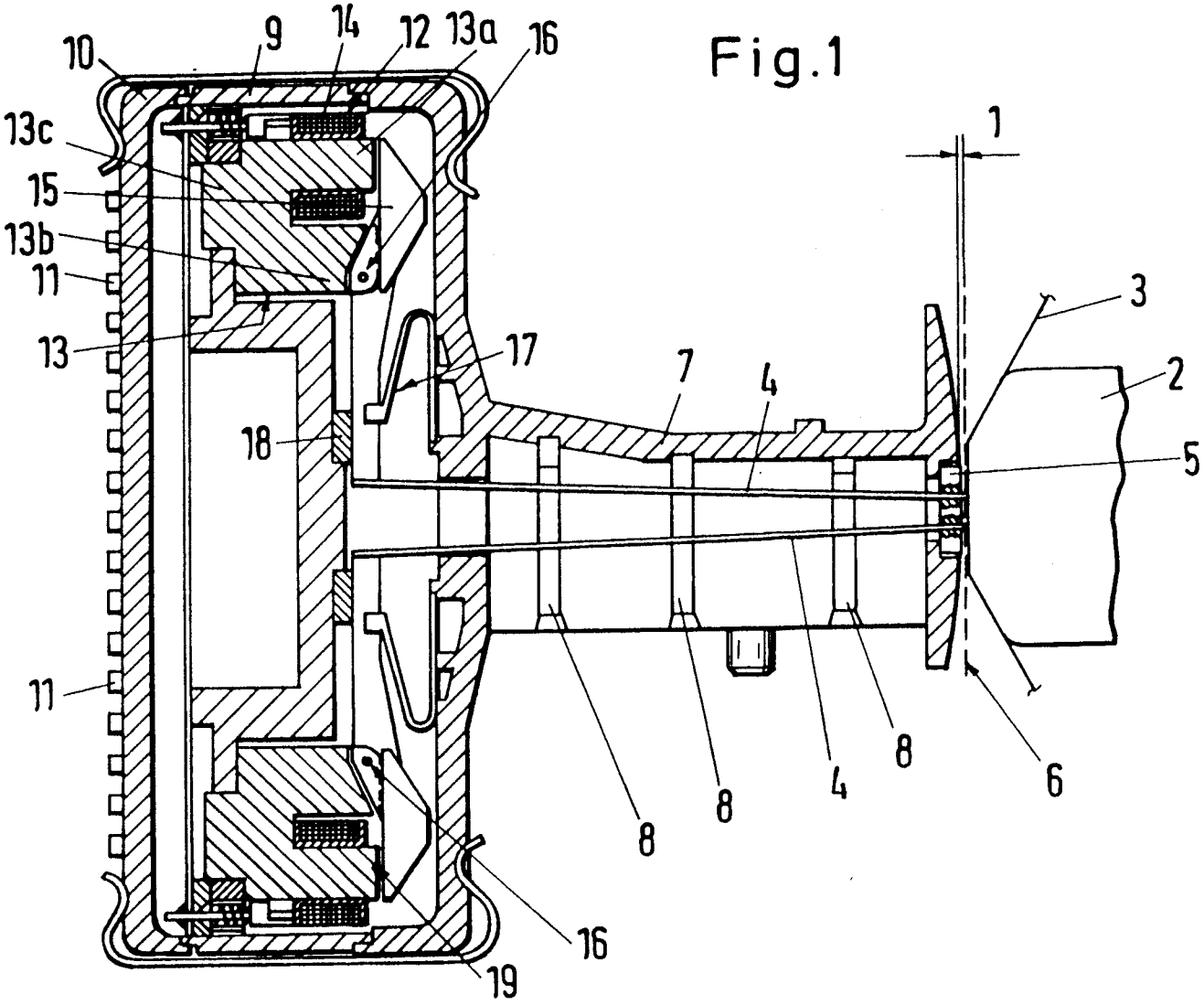
FIG. 1 is a longitudinal sectional view through a serial matrix pin print head.

According to the present invention, there is provided a matrix print head, in particular a serial matrix pin print head. The print head is disposed at a pin stroke distance 1 opposite to a substrate support 2. An imprint-receiving substrate 3 is resting on the substrate support 2. An ink ribbon 6 is guided in front of the substrate support 2. A print pin guide casing 7 and a print pin drive casing 9 are provided on the side of the ink ribbon opposite to the substrate support. An electromagnetic drive 12 is coordinated to each impact pin 4 in the print pin drive casing 9. The electromagnetic drive 12 comprises a magnet yoke 13. An electromagnetic coil 14 is disposed on a magnet yoke arm 13a of the magnet yoke 13. The electromagnetic drive 12 further comprises an armature 15. Said armature 15 is pivotably hinged around a pin bearing 16 rests in a rearward position against a stop 18 based on a spring 17. An operating air gap 20 is formed between the armature 15 and a magnet yoke arm front face 19.

A recess 22 is disposed in the center relative to a magnet yoke thickness 21 perpendicular to the U-configuration of the magnet yoke 13. A pin driving arm 15a of the armature 15 is pivotably submerged in the recess 22 around a hinge pin 23. A hinge pin axis 23a runs laterally relative to a region of a magnet yoke arm center 24, i.e. in the region of the magnet yoke side face 25 of the magnet yoke arm 13a, 13b.

At least one guide plate 15b can be furnished at a side of tile armature 15 disposed opposite to the magnet yoke front face 19. The guide plate 15b can engage into the recess 22 of the magnet yoke 13. The hinge pin axis 23a can pass through recess 22 of the magnet yoke 13.

Both the armature 15 as well as the magnet yoke 13 can be furnished by lamellae 27, disposed layered on top of each other. At least one central recess 22 with a thickness 28a of a lamella 27 can be furnished. The lamella 27 forms the pin driving arm 15a. The armature 15 can be formed with an about trapezoidal cross-section 28 at a position above the two magnet yoke arms 13a, 13b. A lubricant can be intercalated and disposed between the individual lamellae 27.

One magnet yoke 13 with one armature 15 or with one pin driving arm 15a, respectively, and one hinge pin 23 can form one unit in an assembled state of the electromagnetic coil 14.

The matrix print head, illustrated in FIG. 1, represents a serial matrix pin print head, which is disposed with a pin stroke distance 1 opposite to a substrate support 2. An imprint-receiving substrate 3 rests tightly at the substrate support 2. A continuously or discontinuously movable ink ribbon 6 is disposed in front of the imprint-receiving substrate 3 for passing by the ends of the impact pins 4, which impact pins 4 are guided in a mouth piece 5. The impact pins 4 form one or several vertical pin slots of from, for example, $2\times9$ or $2\times12$ impact pins in the mouth piece 5. The entirety of the impact pins 4 is supported and guided in a print pin guide casing 7 with Support plane structures 8. The impact pins 4 run up to a rearward print pin drive casing 9, which is closed by a cover 10. The cover 10 exhibits cooling ribs 11 for the discharge of heat generated by the electromagnetic drives 12.

An electromagnetic drive 12 is coordinated to each impact pin in the print pin drive casing 9. Each electromagnetic drive 12 comprises in each case a magnet yoke 13. Each magnet yoke 13 comprises two magnet yoke arms 13a and 13b as well as a magnet yoke foot 13c. An electromagnetic coil 14 is slid onto a magnet yoke arm 13a, 13b. In addition, one armature 15 is coordinated to each electromagnetic drive 12. Said armature 15 can be pivoted by way of a pin bearing 16 and rests by way of a spring 17 in a rearward position against a stop 18. An operating air gap 20, to be described in detail below, is formed between the armature 15 and a magnet yoke arm front face 19.

A recess 22 in the magnet yoke 13 is formed in the middle relative to the magnet yoke thickness 21. The recess 22, extending in longitudinal direction along and surrounding the armature 15, runs in part in a horizontal direction and in part in a diagonal direction, as illustrated in FIG. 1, or only in a diagonal direction, as illustrated in FIG. 2*a*. As illustrated in FIG. 1, the diagonal section of the recess 22 is placed toward the middle of the yoke and the horizontal direction parallel to the end faces of the magnet disposed near the outside of the magnet toward the center of the print head. A pin driving arm 15*a* of the armature 15 engages into the recess 22*x*. Said pin driving arm 15*a* guides the armature 15 very precisely and avoids thereby lateral cross motions, which would be undesirable. The pin driving arm 15*a* is pivotably supported by means of a bearing pin 23 in the pin bearing 16 and the hinge pin axis 23*a* runs perpendicular to the magnet lamellae plane and laterally relative to the region of the magnet yoke arm center 24. The guide plate or sword 15*b* is attached at the pin driving arm 15*a* or at a trapezoidal cross-section 28, respectively, for a precise lateral guiding.

Figure 2:
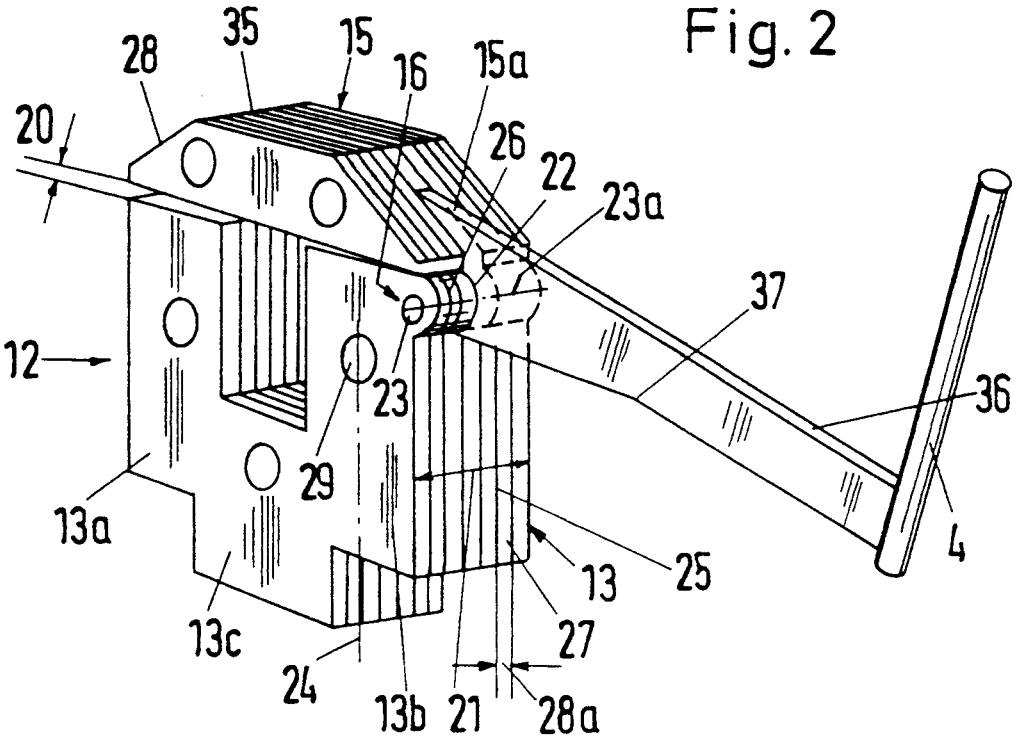
FIG. 2 is a perspective view of a device unit comprising a magnet yoke, an armature and a pin bearing according to a first embodiment of the pin driving arm.

This region of thehinge attachment of the armature 15 resides more at the magnet yoke arm side face 25 and can, for example, coincide with or be disposed on the plane of the magnet yoke arm side face 25, as illustrated in FIG. 2. At any rate, the hinge pin axis 23*a* is under no circumstance to be disposed in the center of one of the magnet yoke arms 13*a* or 13*b*, based on reasons to be described below in detail.

Figure 4:
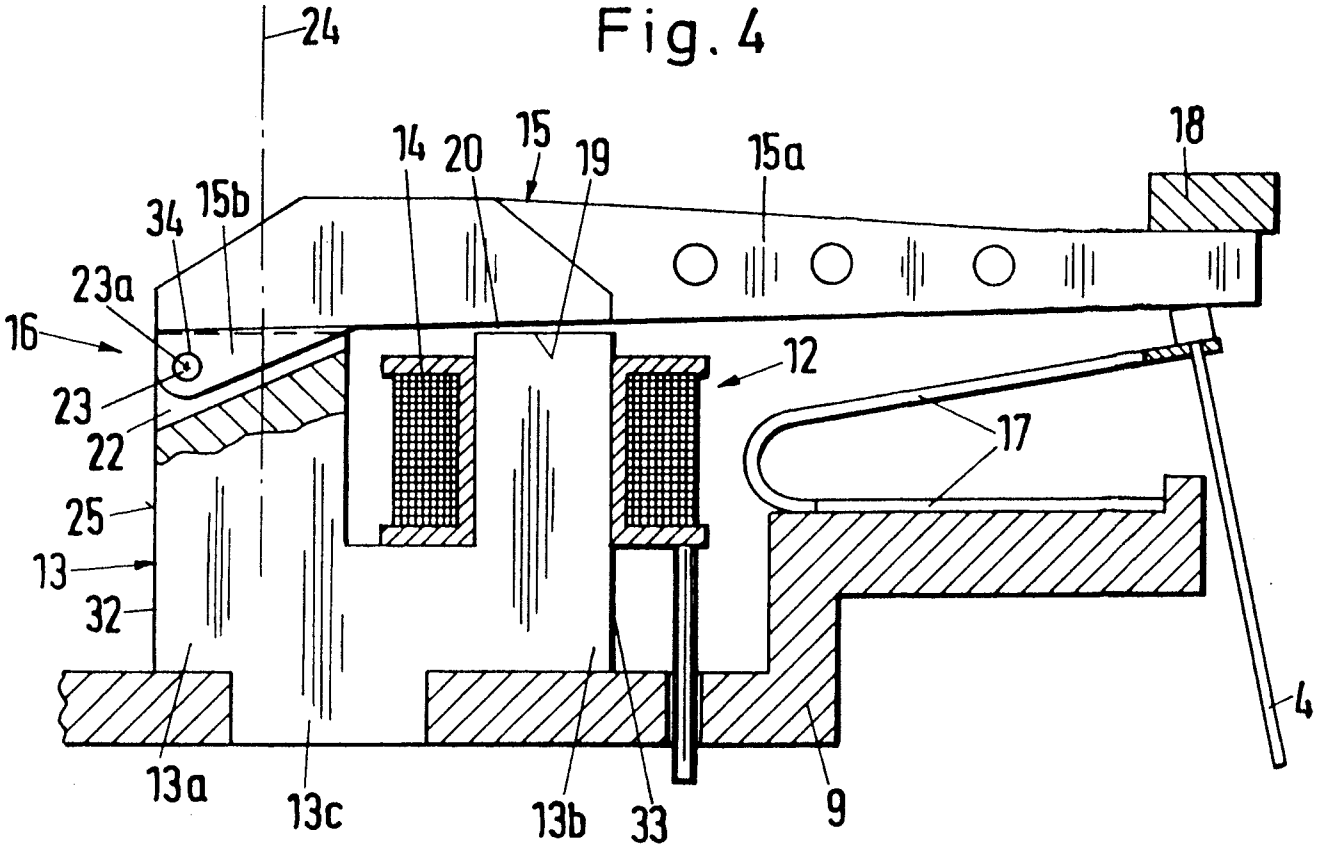
FIG. 4 is a side elevational view of the application of a matrix pin print head for a serial or line-printing matrix print head according to a second embodiment of the pin bearing.

According to FIG. 4, the recess 22 runs exclusively inclined relative to the end faces of the magnet yoke, and a part of the pin driving arm 15*a*, designated in FIG. 4 with reference numeral 15*b*, submerges into the recess 22. In this case again, the horizontal hinge pin axis 23*a* resides laterally relative to the area of the magnet yoke arm center 24 and in fact, in the case of FIG. 4, in the area of the radially outwardly disposed magnet yoke arm side face 25.

The pin bearing 16 according to FIG. 2 forms an eye 26. The eye 26 can be produced, as described in the following, by a punching of the lamellae.

Both the armature 15 as well as the magnet yoke 13 are formed of lamellae 27, disposed as successive layers on top of each other. At least one central recess 22 is present having a thickness 28*a* of a lamella 27, or, alternatively, a thickness corresponding to the sum of thicknesses of several lamellae. One lamella 27, or several lamellae, correspond to a pin driving arm 15*a* of the armature 15. The armature 15 is terminated exactly above the two magnet yoke arms 13*a*, 13*b* and exhibits an about trapezoidal cross-section 28. The trapezoid has angles of less than 45 degrees adjoining the base section of the trapezoid neighboring the end faces of the magnet yoke. Both the armature 15 as well as the magnet yoke 13 can be held together by way of rivets, by point welding or by press-pin connections 29. On the other hand and alternatively, the armature 15 and the magnet yoke 13 can also be produced in sintering tools as single pieces exhibiting the illustrated outer shape. In addition, a lubricant is inserted between the individual lamellae 27 in the lamellae constructions. The lubricant can comprise, for example, graphite or heat-resisting oils obtained from natural or synthetic sources.

Figure 3:
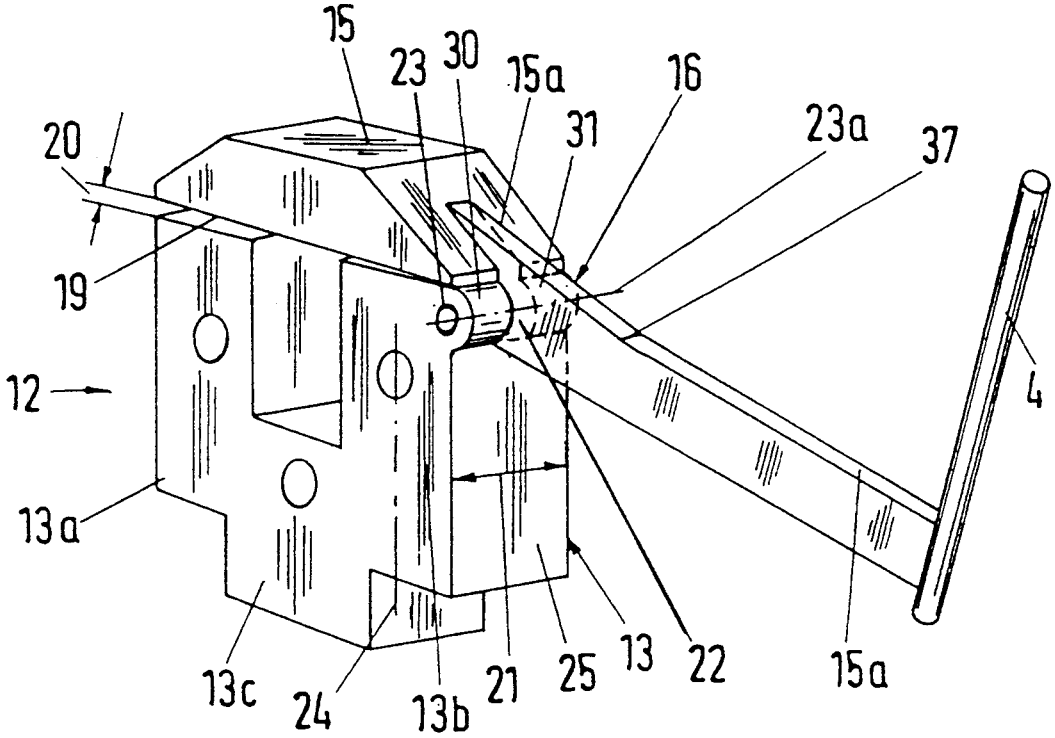
FIG. 3 is a perspective view of a device unit similar to FIG. 2, but according to a second embodiment of the pin driving arm.

As illustrated in FIGS. 2 and 3 or 4, respectively, a magnet yoke 13 with an armature 15 or a pin driving arm 15*a*, respectively, and a hinge pin 23 in each case form a device unit in the assembled state of the electromagnetic coil 14, where the electromagnetic coil is not shown in FIGS. 2 and 3 for purposes of clarity of the drawings.

The electromagnetic drive 12, comprising in each case a magnet yoke 13, where an electromagnetic coil 14 can be slid onto one magnet yoke arm 13*a* or 13*b*, respectively, of the magnet yoke 13, and further comprising an armature 15, is furnished with a pin bearing 16. The precision of the position, of the dimensions, and of the basic disposition of the parts as well as the desired effective magnetic flux are achieved based on the following steps during production or mounting, respectively:

1. Punching of the magnet yoke lamellae 27 with outer form and prepunching of a hole for the pin bearing 16;

2. Forming packets of the thus punched magnet yoke lamellae 27 for the purpose of generating a pin hole with an inner rough diameter;

3. Calibration of the rough pin hole to a predimension;

4. Insertion of the armature 15 without the impact pin 4 or of the armature 15 with the impact pin 4, respectively, in such a way that a center armature lamella 35 engages into a central recess 22 between two lateral lamella packets 30 and 31;

5. Alignment of the armatures 15 at tile outer edges 32 and 33 of the magnet yoke 13;

6. Subsequent insertion of a punching stamp 34 into the calibrated pin hole, whereby the center armature lamella 35 is finish stamped; wherein the armature 15 rests without air gap on the magnet yoke arm front face 19, and wherein the punching stamp 34 simultaneously serves as a bearing pin 23.

The device group unit according to FIG. 2 includes a pin driving arm 15*a*, which is furnished at its "upper side" with a straight course edge 36. In contrast, the "lower side" of the pin driving arm 15*a* is furnished with a point 37 of a discontinuous edge direction. The larger width of the pin driving arm 15*a* is still disposed in the neighborhood of the pin bearing 16.

The device group unit is formed and structured differently according to FIG. 3. The largest width of the pin driving arm 15*a* is placed in the region of the pin bearing 16, according to the embodiment of FIG. 3, however the course direction of the edge of the pin driving arm 15*a* at the "lower side" is straight, whereas the edge tangential direction of the edge of the pin driving arm 15*a* at the "upper side" is discontinuous. Depending on the application, the discontinuous tangential edge direction 37 results in a larger vibrational stiffness and a larger oscillation stability.

The position of the hinge pin axis 23*a* can be from about 1/20 to 1/5 of the diameter of the magnet yoke arm away from the outer edge from the outer side of this magnet yoke arm or can be distanced 1/20 to 1/5 from the top surface of this magnet yoke arm. The magnet yoke arm, supporting the hinge pin axis can be provided with a side protrusion such that the hinge pin axis intersects with the corresponding side plane of the magnet yoke arm as illustrated in FIG. 2 and FIG. 3.

Figure 5:
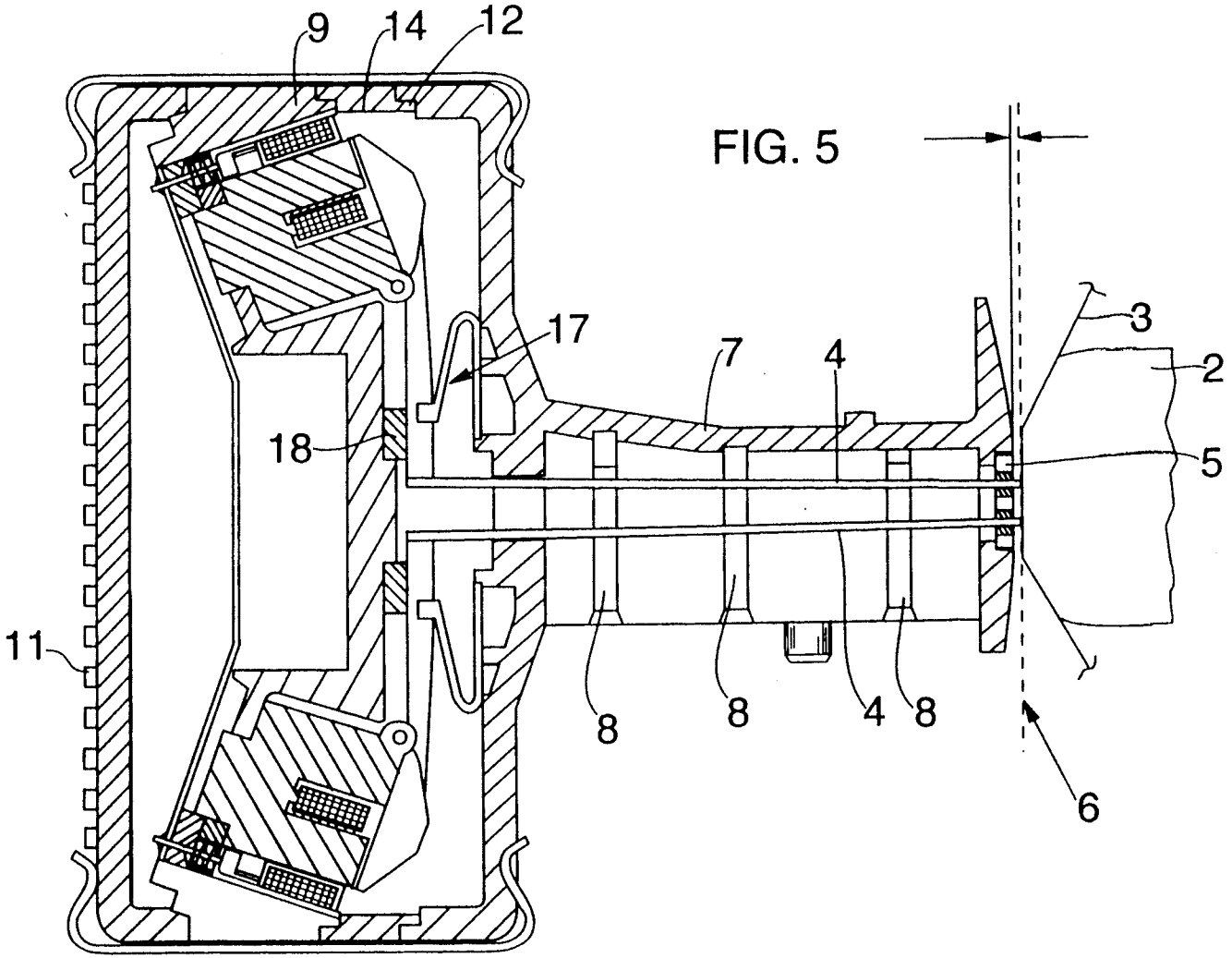
FIG. 5 is a sectional view of a further embodiment similar to FIG. 1.

Preferably, the axis 23 is disposed at the center of gravity of the armature structure or at least less than 1/50 or less than 1/20 of the length of the armature 15 from the center of gravity of the armature. To achieve this, the magnet yokes can be aligned such that they form an angle such that the magnet yoke arm faces, facing the armature, are disposed in a plane which forms an angle relative to the plane of the print substrate such that the foot of the magnet yoke is disposed closer to the axis of the print head and the magnet yoke arms are disposed further removed relative to the axis of the print head as compared to a position, where the magnet yoke arm direction would be substantially parallel to the print head direction. The angle of the magnet yoke relative to the print head axis can be from about 10 to 45 degrees and is preferably between 20 and 30 degrees, as illustrated in FIG. 5.

Figure 6:
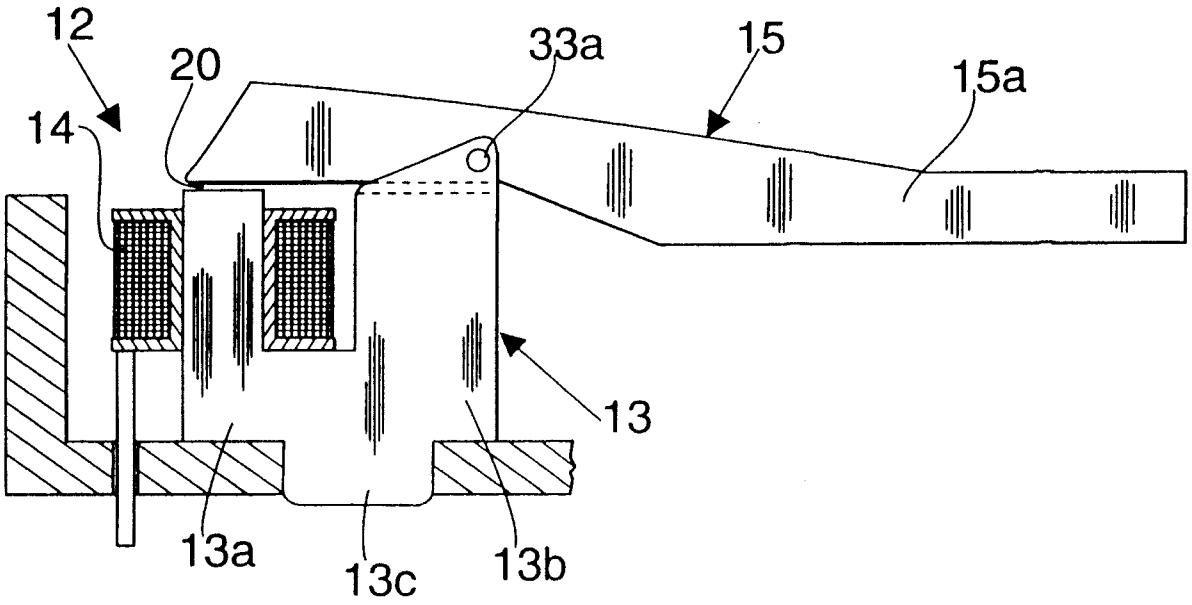

Alternatively, the hinge pin axis 23*a* of FIGS. 2–4 can be formed in the area of the soft-magnetic parts of the armature and one or two lamellae of the magnet yoke can extend into the general area of the magnetic body of the armature such that the hinge pin axis 23*a* between the magnet yoke and the armature is disposed on the side of the magnet facing away from the position of the magnet yoke. In such a case, it would be necessary that the armature base side would be formed curved in an end area toward the print head axis defined by a plane perpendicular to the face plane of the magnet yoke arms and passing through the hinge pin axis such that the motion of the armature would not be inhibited by a dispositioning of the axis (FIG. 6). This means that the contact face between the armature and the magnet yoke would not be able to extend beyond the perpendicular projection of the hinge pin axis 33*a* onto the plane formed by the magnet yoke arm faces. The hinge pin axis 33*a* can be from one tenth to one quarter of the thickness of the respective leg of the magnet yoke disposed above the plane of the end faces of the magnet yoke. The hinge pin axis 33*a* can be disposed on a parallel plane relative to the side plane of the magnet yoke toward the print head axis, which is not more than one tenth of the thickness of a leg of the magnet yoke away front said side plane.

It will be understood that each of the elements described above, or two or more together, may also find a useful application in other types of print heads differing from the types described above.

While the invention has been illustrated and described as embodied in the context of a matrix print head, and in particular of a serial matrix pin print head, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A matrix print head, in particular a serial matrix pin print head, comprising a print pin drive casing frame having a middle area;

a magnet yoke having a first magnet yoke arm and having a second magnet yoke arm and attached to the print pin drive casing and including a recess disposed in the center relative to a magnet yoke thickness located perpendicular to a U-configuration of the magnet yoke;

an electromagetic coil disposed on the first magnet yoke arm of the magnet yoke;

a hinge pin having a hinge pin axis disposed near a corner of the U-configuration of the magnet yoke, wherein the hinge pin axis is disposed on an outer side of the second magnet yoke arm at a level below an end face of the first magnet yoke arm as seen when the magnet yoke arms are directed upwardly, and wherein said hinge pin is held by the magnet yoke and passes through the recess;

an armature associated with the magnet yoke and including a pin driving arm, wherein the pin driving arm of the armature is pivotably hinged around the hinge pin and submerged in the recess around the hinge pin;

a stop for providing a rest position for the armature in a rearward position;

a spring pressing the armature against the stop based on an elastic force of the spring such that an operating air gap is present between the armature and a front face of one of the magnet yoke arms;

an impact pin attached with a first end to the armature and disposed with a second end at a print pin stroke distance opposite to a position for a substrate such that an ink ribbon is disposed between the impact pin and the position of the substrate;

a print pin guide casing attached to the print pin drive casing frame for guiding the impact pin.

2. The matrix print head according to claim 1, wherein the hinge pin axis runs laterally relative to a region of a center of the one of the magnet yoke arms that is in the region of a side face of one of the magnet yoke arms.

3. The matrix print head according to claim 1, further comprising at least one guide plate attached to the armature and furnished at a side of the armature disposed opposite to a front face of the magnet yoke, wherein the guide plate engages into the recess of the magnet yoke; and wherein the hinge pin axis passes through the recess of the magnet yoke.

4. The matrix print head according to claim 1, wherein the hinge pin is solidly attached to the armature.

5. The matrix print head according to claim 1, wherein the hinge pin is solidly attached to the magnet yoke.

6. The matrix print head according to claim 1, wherein the armature and the magnet yoke are furnished by lamellae, wherein the lamellae are disposed layered on top of each other, wherein at least one recess, disposed centrally relative to the magnet yoke, is furnished with a thickness of a second lamella, which second lamella forms the pin driving arm, and wherein the armature is formed with an about trapezoidal cross-section at a position opposing the faces of the two arms of the magnet yoke.

7. The matrix print head according to claim 6, wherein a lubricant is intercalated and disposed between neighboring individual lamellae.

8. The matrix print head according to claim 1, wherein the magnet yoke, the armature having a pin driving arm, and the hinge pin form an exchangeable, removable, and substitutable drive unit for an assembled state of the electromagnetic coil.

9. The matrix print head according to claim 1, wherein said hinge pin axis is disposed relatively close to said middle area.

10. The matrix print head according to claim 1 further comprising a recess disposed on the magnet yoke in a center area relative to a magnet yoke thickness extending in a plane disposed parallel to a plane of the U-configuration of the magnet yoke, wherein a gap provided by the recess corresponds to a thickness of a center lamellae of the magnet yoke.

11. The matrix print head according to claim 1 wherein the recess is disposed on the magnet yoke in the center defined by a plane disposed perpendicular to the hinge pin axis, wherein the hinge pin passes through the recess with the elongated extension of the pin directed perpendicular to the plane of the U-shaped magnet yoke.

12. The matrix print head according to claim 11, wherein the hinge pin axis is disposed at a position laterally shifted relative to a region of the center of the magnet yoke.

13. The matrix print head according to claim 11, wherein the hinge pin axis is disposed at a position in a region of an outer side face of one of the magnet yoke arms.

14. The matrix print head according to claim 11 wherein the recess exhibits a thickness of a respective lamella of the armature.

15. The matrix print head according to claim 11, wherein the armature is formed with a trapezoid defining a cross-section when projecting the armature into a plane spanned by the U-configuration of the magnet yoke;

wherein a longer one of bases of the trapezoid is disposed next to the end face of the magnet yoke arms and wherein a shorter one of the bases of trapezoid is disposed relative remote to the magnet yoke.

16. The matrix print head according to claim 15, wherein the armature is formed with a trapezoid defining a first arm of a two armed lever and wherein a pin driving arm furnishes a second arm of the two armed lever;

wherein the armature ends immediately above the two magnet yoke arms;

wherein the trapezoid has angles of less than 45 degrees adjoining the base section of the trapezoid neighboring the end faces of the magnet yoke.

17. The matrix print head according to claim 11, further comprising a pin driving arm submerged partly in the recess and attached to the armature and pivotably hinged around the hinge pin.

18. The matrix print head according to claim 11, wherein the recess is defined inclined relative to the end face of the first magnet yoke arm;

wherein a pin driving arm submerges into the recess;

wherein the hinge pin axis resides disposed laterally relative to the respective magnet yoke arm center in the area of the radially outwardly disposed side of the respective magnet yoke arm.

19. The matrix print head according to claim 11, wherein the magnet yoke, the armature with the pin driving arm, the hinge pin form an exchangeable device unit and wherein the pin bearing arm in the pin bearing region exhibits a large width in a plane disposed parallel to the U-configuration of the magnet yoke as compared to the area of the pin bearing arm near the pin.

20. The matrix print head according to claim 11, wherein the position of the hinge pin axis is from about 1/20 to 1/5 of a diameter of the magnet yoke arm away from an outer edge of one respective magnet yoke arm;

wherein the respective magnet yoke arm supporting the hinge pin is furnished with a side projection such that the hinge pin axis intersects with a corresponding side plane of the respective magnet yoke arm.

21. The matrix print head according to claim 11, wherein the position of the hinge pin axis is from about 1/20 to 1/5 of a diameter of the magnet yoke arm away from a top surface of one respective magnet yoke arm;

wherein the hinge axis is disposed at least less than 1/20 of the length of the armature away from the center of gravity of the armature.

22. The matrix print head according to claim 11 wherein an axis of the hinge pin is disposed at the center of an armature structure including the armature proper, the pin driving arm and the print pin;

wherein the magnet yoke is aligned such that the magnet yoke forms an angle such that faces of the first magnet yoke arm and of the second magnet yoke arm, facing the armature, are disposed in a plane which forms an angle relative to a plane of the print substrate such that a foot of the magnet yoke is disposed closer to an axis of the print head and such that the arms of the magnet yoke are disposed further removed relative to the axis of the print head as compared to a position, where a direction of the arm of the magnet yoke would be substantially parallel to the print head direction; and wherein the angle of the magnet yoke to the print head axis is from about 10 to 40 degrees.

23. The matrix print head according to claim 11 wherein an axis of the hinge pin is disposed less than 1/20 of a length of the armature from a center of the armature;

wherein the hinge pin axis is formed in the area of the soft magnetic parts of the armature and wherein a lamella of the magnet yoke extends into the area of the magnet body of the armature such that the hinge pin axis between the magnet yoke and the armature is disposed on the side of the magnet facing away from the position of the magnet yoke; and wherein the base side of the armature is formed curved in an end area toward the print head axis defined by a plane perpendicular to the face plane of the magnet yoke arms and passing through the hinge pin axis such that the motion of the armature is not inhibited by a position of the axis.

24. The matrix print head according to claim 11 wherein an axis of the hinge pin is disposed less than 1/50 of a length of the armature from a center of the armature;

wherein a contact face between the armature and the magnet yoke does not extend beyond a perpendicular projection of the axis of the hinge pin onto a plane formed by faces of the arm of the magnet yoke;

wherein the hinge pin axis has a thickness of from one tenth to one quarter of a respective arm of the magnet yoke disposed above a plane defined by end faces of the magnet yoke; and wherein the axis of the hinge pin is disposed on a plane parallel to a side plane of the magnet yoke toward an axis of the print head, and wherein the plane parallel is disposed not more than one tenth of a thickness of the arm of the magnet yoke away from a side plane of the magnet yoke.

25. The matrix print head according to claim 11 wherein the hinge pin is attached to the arm of the magnet yoke disposed remote relative to an axis of the print head; wherein the hinge pin intersects the arm of the magnet yoke near an outer corner of the respective arm of the magnet yoke.

26. A matrix print head, in particular a serial matrix pin print head, comprising a print pin drive casing frame having a middle area;

a magnet yoke having a first magnet yoke arm and having a second magnet yoke arm and attached to the print pin drive casing;

a hinge pin support disposed at the magnet yoke in the center relative to a magnet yoke thickness measured perpendicular to a U-configuration of the magnet yoke, and said hinge pin support located near a corner of the U-configuration;

an electromagnetic coil disposed on the first magnet yoke arm of the magnet yoke;

a hinge pin having a hinge pin axis disposed in the hinge pin support and wherein the hinge pin axis is disposed near a corner of the U-configuration of the magnet yoke, wherein the hinge pin axis is disposed on an outer side of the second magnet yoke arm at a level below an end face of the first magnet yoke arm as seen when the magnet yoke arms are directed upwardly;

an armature associated with the magnet yoke and including a pin driving arm, wherein the pin driving arm of the armature is pivotably hinged around the hinge pin;

a stop for providing a rest position for the armature;

a spring pressing the armature against the stop based on an elastic force of the spring such that an operating air gap is present between the armature and a front face of a magnet yoke arm;

an impact pin attached with a first end to the armature and disposed with a second end at a print pin stroke distance opposite to an imprint-receiving substrate such that an ink ribbon is disposed between the impact pin and the imprint-receiving substrate;

a print pin guide casing attached to the print pin drive casing frame for guiding the impact pin.

27. The matrix print head according to claim 26, wherein said hinge pin axis is disposed relatively close to said middle area.

28. The matrix print head according to claim 26, wherein said hinge pin axis is disposed relatively close to the middle area and immediately in front of a respective end face of the arm of the magnet yoke.

29. The matrix print head according to claim 26, wherein the hinge pin axis is disposed less than one fiftieth of the length of the impact pin away from the center of gravity of the armature and the impact pin.

30. The matrix print head according to claim 26, wherein the hinge pin axis is disposed near an arm of the magnet yoke disposed relatively far away from the middle area.

31. The matrix print head according to claim 26, wherein the hinge pin bearing includes two plates attached to the magnet yoke for supporting the hinge pin.

32. A matrix print head, in particular a serial matrix pin print head, where the print head is disposed at a pin stroke distance (1) opposite to a substrate support (2), where an imprint-receiving substrate (3) is resting on the substrate support (2), and where an ink ribbon (6) is guided in front of the substrate support (2), wherein a print pin guide casing (7) and a print pin drive casing (9) are provided on the side of the ink ribbon opposite to the substrate support, wherein an electromagnetic drive (12) is coordinated to each impact pin (4) in the print pin drive casing (9), where the electromagnetic drive (12) comprises a magnet yoke (13), where an electromagnetic coil (14) is disposed on a magnet yoke arm (13*a*) of the magnet yoke (13), and wherein the electromagnetic drive (12) further comprises an armature (15), which armature (15) is pivotably hinged around a pin bearing (16) and wherein the pin bearing is disposed near a corner of a U-configuration of the magnet yoke (13), wherein the pin bearing is disposed on an outer side of a second magnet yoke arm at a level below an end face of the magnet yoke arm associated with the electromagnetic coil (14) as seen when the magnet yoke arms are directed upwardly, and which armature (15) rests in a rearward position against a stop (18) based on a spring (17), and wherein an operating air gap (20) is formed between the armature (15) and a magnet yoke arm front face (19), wherein a recess (22) is disposed in the center relative to a magnet yoke thickness (21) perpendicular to the U-configuration of the magnet yoke (13), wherein a pin driving arm (15*a*) of the armature (15) is pivotably submerged in the recess (22) around a hinge pin (23), wherein a hinge pin axis (23*a*) runs laterally relative to a region of a magnet yoke arm center (24) that is in the region of the magnet yoke side face (25) of the magnet yoke arm (13*a*, 13*b*).

33. The matrix print head according to claim 32, wherein at least one guide plate (15*b*) is furnished at a side of the armature (15) disposed opposite to the magnet yoke front face (19), wherein the guide plate (15*b*) engages into the recess (22) of the magnet yoke (13), and wherein the hinge pin axis (23*a*) passes through the recess (22) of the magnet yoke (13).

34. The matrix print head according to claim 32, wherein both the armature (15) as well as the magnet yoke (13) are furnished by lamellae (27), disposed layered on top of each other, wherein at least one central recess (22) with a thickness (28*a*) of a lamella (27) is furnished, which lamella (27) forms the pin driving arm (15*a*), and wherein the armature (15) is formed with an about trapezoidal cross-section (28) at a position above the two magnet yoke arms (13*a*, 13*b*).

35. The matrix print head according to claim 34, wherein a lubricant is intercalated and disposed between the individual lamellae (27).

36. The matrix print head according to claim 32, wherein one magnet yoke (13) with one armature (15) and with one pin driving arm (15*a*), respectively, and one hinge pin (23) form an exchangeable, removable, and substitutable unit in an assembled state of the electromagnetic coil (14).

* * * * *